US005440961A

United States Patent [19]

Lucas, Jr. et al.

[11] Patent Number: 5,440,961

[45] Date of Patent: Aug. 15, 1995

[54] FILM CUTTING APPARATUS AND METHOD

[75] Inventors: Earl S. Lucas, Jr., Glen Allen; Jack R. McLean, Richmond; Donald E. Vaughan, Chesterfield County, all of Va.

[73] Assignee: Reynolds Metals Company, Richmond, Va.

[21] Appl. No.: 185,335

[22] Filed: Jan. 24, 1994

[51] Int. Cl.[6] ..... B26D 1/18

[52] U.S. Cl. ..... 83/455; 83/489; 83/578; 83/614

[58] Field of Search ..... 83/578, 56, 489, 614, 83/455

[56] References Cited

U.S. PATENT DOCUMENTS

| | | | |
|---|---|---|---|
| 26,052 | 11/1859 | Pye . | |
| 342,127 | 5/1886 | Panyard . | |
| 745,517 | 12/1903 | Perks . | |
| 821,757 | 5/1906 | Smith . | |
| 821,866 | 5/1906 | Dobbs et al. . | |
| 909,227 | 1/1909 | Ridgely . | |
| 992,755 | 5/1911 | Crocker | 83/455 |
| 2,219,485 | 10/1940 | Neuwirth | 83/489 |
| 2,252,888 | 8/1941 | Goserud . | |
| 2,624,408 | 1/1953 | Stein | 83/455 |
| 3,071,034 | 1/1963 | Castelli | 83/578 |
| 3,137,192 | 6/1964 | McNeill . | |
| 3,561,312 | 2/1971 | Jones . | |
| 3,688,625 | 9/1972 | Thomas et al. . | |
| 3,766,816 | 10/1973 | Loveless | 83/489 |
| 3,791,246 | 2/1974 | Lazickas | 83/455 |
| 3,981,215 | 9/1976 | Granger et al. . | |
| 4,020,550 | 5/1977 | Okada . | |
| 4,046,044 | 9/1977 | Paterson et al. | 83/489 |
| 4,062,116 | 12/1977 | Arnott . | |
| 4,086,835 | 5/1978 | Frederick | 83/614 |
| 4,210,043 | 7/1980 | Urion et al. . | |
| 4,245,536 | 1/1981 | Urion . | |
| 4,691,605 | 9/1987 | Vanetik et al. . | |
| 4,754,674 | 7/1988 | Perlman . | |
| 4,787,284 | 11/1988 | Chen . | |
| 4,960,022 | 10/1990 | Chuang . | |
| 5,036,740 | 8/1991 | Tsai . | |
| 5,044,241 | 9/1991 | Labrecque . | |
| 5,322,001 | 6/1944 | Boda | 83/455 |

FOREIGN PATENT DOCUMENTS

| | | | |
|---|---|---|---|
| 678401 | 1/1964 | Canada . | |
| 0661129 | 11/1951 | United Kingdom | 83/489 |
| 445016 | 12/1974 | U.S.S.R. . | |

*Primary Examiner*—Kenneth E. Peterson
*Attorney, Agent, or Firm*—Alan T. McDonald

[57] ABSTRACT

A film cutting apparatus includes a guide having a clip for attachment to a film material container and a cutting device designed to travel along said guide to sever the film material in predetermined lengths. The cutting device includes two pairs of guide wheels designed to travel in a channel in the guide beneath the cutting plane defined by a top surface thereof. The cutting device also includes a housing having disposed therein a star cutter, a star cutter driver assembly and a plate assembly attached to the housing providing rotatable support for the star cutter driver assembly and guide wheels. In use, the housing is gripped by a user and driven along the length of the guide. During housing travel, the star cutter driver assembly rotatably engages the guide top surface to rotate the star cutter and sever the film material lying in the path of the star cutter. The guide has a non-slip top surface so that the film material adheres thereto during cutting. The star cutter drive assembly includes a resilient material engaging surface to compensate for variations in film material thickness during cutting.

6 Claims, 3 Drawing Sheets

FILM CUTTING APPARATUS AND METHOD

FIELD OF THE INVENTION

The present invention is directed to a film cutting method and apparatus and, in particular, to a star wheel cutting device in combination with a cutting guide to sever film material, such as foodservice wrap.

BACKGROUND OF THE INVENTION

In the prior art, various types of film material cutting apparatus have been proposed utilizing a traveling cutter. U.S. Pat. No. 4,960,022 to Chuang discloses a plastic film cutter comprising a supporting board, a sliding furrow formed in the top of the supporting board and a slidable cutting means having a lower sliding seat insertable into the sliding furrow. In Chuang, rollers are provided for engaging and maintaining the plastic film in a tensioned state above the upper surface of the plastic film.

Other patents disclosing film cutters include U.S. Pat. Nos. 5,036,740 to Tsai, 5,044,241 to Labrecque and 4,787,284 to Chen.

However, prior art devices using a cutting blade are ineffective to handle or accommodate variations in film material thickness, such as bunched or doubled over film. Likewise, apparatus such as disclosed in Labrecque involve complex mechanical interaction to achieve effective cutting.

In response to these deficiencies, a need has developed to provide an effective yet simple film cutting apparatus which overcomes deficiencies in prior art designs.

In response to this need, the present invention provides a simple yet effective film cutting apparatus design which severs film material easily and efficiently.

SUMMARY OF THE INVENTION

Accordingly, it is a first object of the present invention to provide an improved film cutting apparatus and method.

It is a further object of the present invention to provide a film cutting apparatus and method which includes a star cutter wheel driven by a roller assembly which effectively severs film material.

Another object of the present invention is to provide a film cutting apparatus and method wherein the film material is held in place independently of the cutting device to permit ease of cutting operation.

Other objects and advantages of the present invention will become apparent as the description thereof proceeds.

In satisfaction of the foregoing objects and advantages, the present invention provides a cutting device comprising a housing and a toothed cutting wheel of a first diameter, the toothed cutting wheel disposed in at least a portion of the housing. A rotating means for rotating the toothed cutting wheel is disposed in at least a portion of the housing and includes a resilient film material engaging surface thereon which defines a cutting plane coincident with the film material being cut. A plurality of guide wheels for guiding the cutting device during travel thereof are positioned beneath the cutting plane by a supporting means attached to the housing. The supporting means also supports the rotating means which is disposed above the cutting plane for rotatable movement thereof as well as for driving and rotating the toothed cutting wheel.

In conjunction with the cutting device, a cutting guide comprises an elongated member having a channel therethrough which is sized to receive the guide wheels of the cutting device. The elongated member has a top surface parallel to the cutting plane, the top surface having a high friction surface thereon to adhere the film material thereto during cutting thereof. The elongated member also has a slot in the top surface in communication with the channel, the slot being sized to receive the cutting wheel during rotation thereof, as well as the means for supporting the guide wheels.

In a preferred embodiment, the rotating means for rotating the cutting wheel comprises a roller assembly made up of two rollers which interconnect to fixedly mount the toothed cutting wheel thereto. Each of the rollers has recesses along a circumferential edge thereof to receive an O-ring which provide resilient engagement with the film material during cutting. A pair of plates, attached to the housing, are also disposed between the rollers, the cutting wheel disposed therebetween. The plates provide rotatable support for the rollers during travel of the cutting device, as well as spaced apart support of the guide wheels during travel in the channel of the cutting guide.

In the method aspect of the invention, the cutting device and cutting guide are mounted adjacent to a source of film material for cutting a predetermined length. The film material is adhered to the high friction surface of the cutting guide. Following the adhering step, the cutting device travels along the guide with the O-rings engaging the upper surface of the film material, rotation thereof driving the toothed cutting wheel to perforate and sever the film material. The guide wheels travel in the channel of the cutting guide and provide guidance and stability to the cutting device during longitudinal movement thereof.

BRIEF DESCRIPTION OF THE DRAWINGS

Reference is now made to the drawings describing the invention wherein.

DETAILED DESCRIPTION OF THE PREFERRED EMBODIMENT

Figure 1:
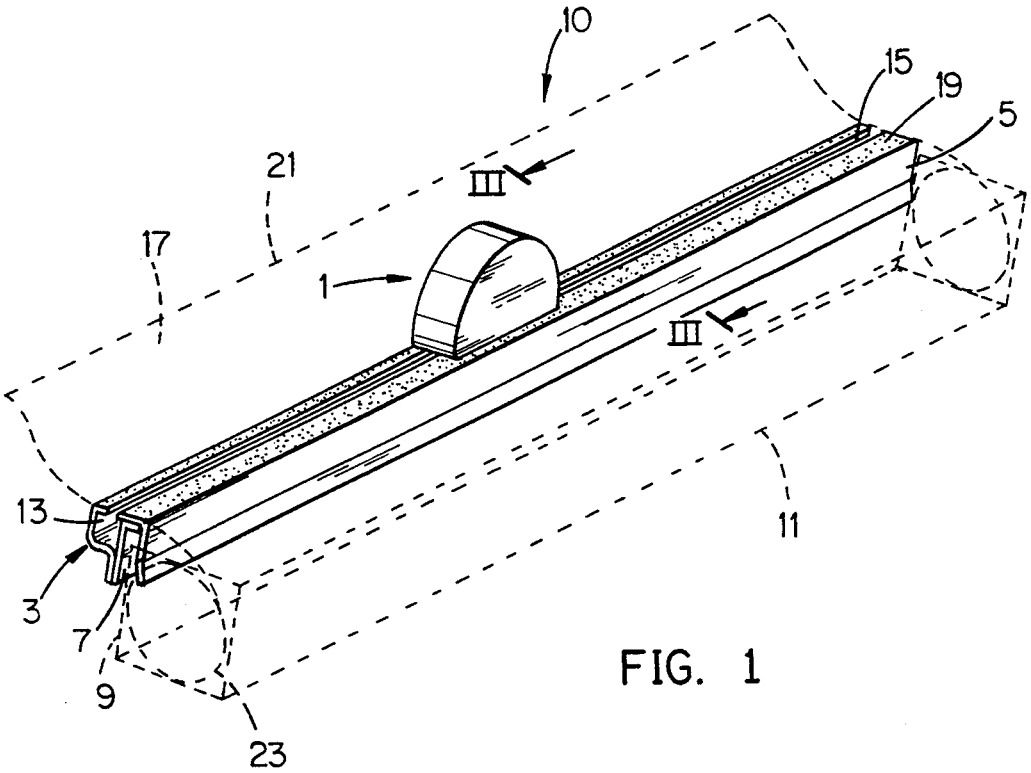
FIG. 1 is a perspective view of the film cutting apparatus showing an exemplary use.

With reference to FIG. 1, the inventive film cutting apparatus is generally designated by the reference numeral 10 and includes a cutting device 1 which is designed to travel along a guide 3. The guide 3 has a clip 5 which forms a recess 7 to receive a sidewall 9 of an elongated film material container 11.

The guide 3 also includes a channel 13 and slot 15. The channel 13 receives guide wheels (not shown) of the cutting device 1 with the slot 15 providing an opening which permits cutting of the film material 17 and support of the guide wheels.

The guide 3 also has a non-slip top surface 19 which retains and tensions the film material 17 during cutting thereof. The nonslip surface 19 is preferably a urethane tape which is adhered to the guide 3. Of course, other coatings or tapes may be used to create a non-slip surface on the guide 3, as long as the material provides a sufficiently high friction surface such that the film material 17 clings thereto.

In use, the guide 3 is placed on the sidewall 9. A predetermined length of the film material 17, as measured from the free end 21 thereof to the slot 15, is unraveled from the film material roll 23. The film material 17, once contacting the nonslip surface 19, adheres thereto for subsequent cutting. The cutting device 1 is then passed through the channel 13 and slot 15 to sever the film material 17 while it is tensioned by the non-slip surface 19. The function of the cutting device 1 in relation to the channel 13 and slot 15 will be described hereinafter.

The film material 17 may be any known material having a thickness which is easily severed by a rotating cutting blade. For example, the film material 17 may include typical foodservice wraps, such as aluminum foil or plastic wrap.

Figure 2:
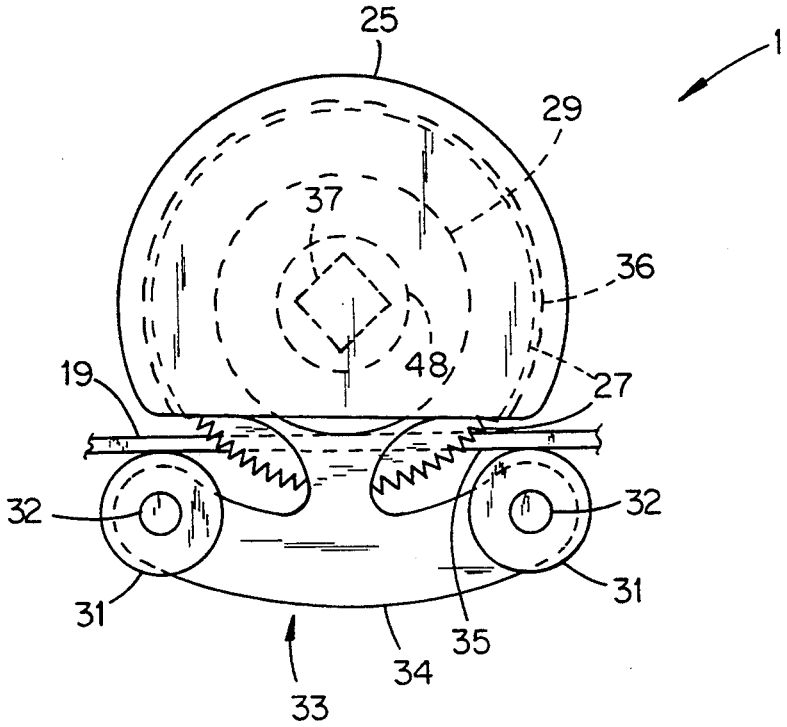
FIG. 2 is a side view of the cutting device in engagement with a portion of the cutting guide.

With reference now to FIG. 2, a side view of the cutting device is illustrated depicting a housing 25 enclosing at least a portion of a star cutter 27 and a star cutter driver assembly 29. The housing is preferably sized for hand holding to facilitate manual cutting action.

The cutting device further includes two pairs of guide wheels 31, one guide wheel of each pair depicted in FIG. 2. The pairs of guide wheels are rotatably mounted on axles 32 and supported by the guide wheel support plates 33, only one support plate shown in FIG. 2.

Each of the guide wheel support plates 33 comprises an elongated connector 34 which positions the guide wheels 31 in a spaced apart relationship from each other and with respect to the under surface 35 and which preferably extends laterally beyond the guide wheels 31 to protect the guide wheels from contacting end stops of channel 13 during movement of the cutting device 1 through channel 13. A circular portion 36 of each plate 33 provides connection between the connector 34 and the housing 25, as well as rotatable support for the star cutter driver assembly 29, as described hereinafter.

During cutting of the film material 17, the star cutter driver assembly 29 rotates and travels along the non-slip surface 19 with the guide wheels 31 contacting the opposing surface 35 in the channel 13; see FIG. 1. As will described hereinafter, travel and rotation of the star cutter driver assembly 29 rotates the star cutter 27 during linear movement of the cutting device 1 to sever the film material 17 along the slot 15.

Figure 3:
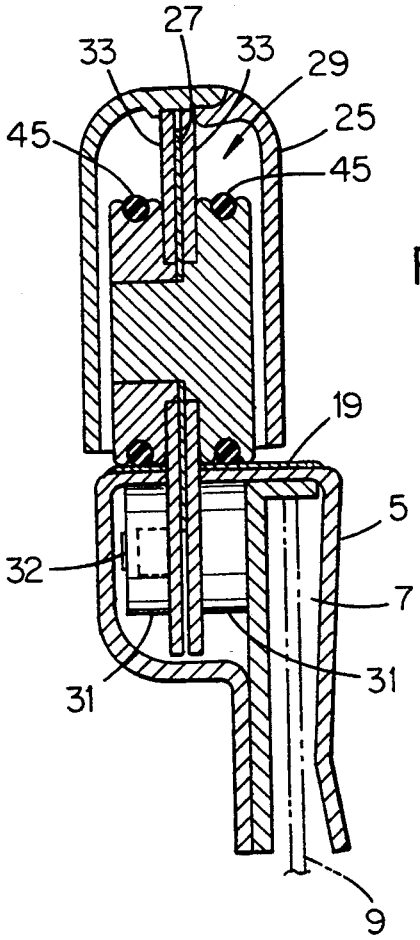
FIG. 3 is a cross-sectional view of the cutting device taken along the line III—III of FIG. 1.
Figure 4:
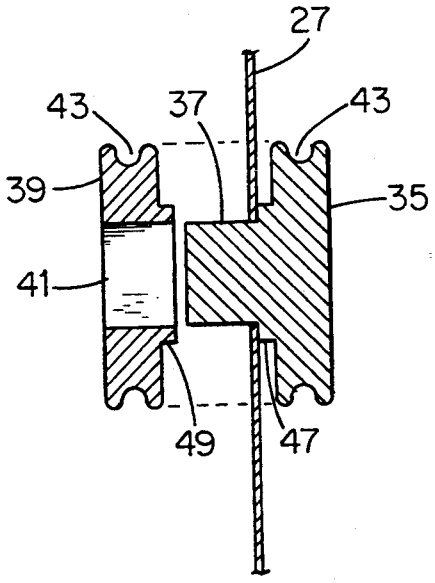
FIG. 4 is an cross-sectional view of the roller depicted in FIG. 3.

With reference to FIGS. 3 and 4, the star cutter driver assembly 29 is designed to provide a fixed mount for the star cutter 27 while still rotating with respect to the linearly traveling guide wheel support plates 33.

With particular reference to FIG. 4, the star cutter driver assembly includes a first roller 35 having a male portion 37 extending therefrom. A second roller 39 includes a female opening 41 sized to engage the male portion 37 of the first roller 35. In cross section, the male portion 37 is square in shape; see FIG. 2, to fixedly mount the star cutter 27 thereon. As can be seen from FIG. 4, the star cutter 27 is fixedly mounted on the male portion 37.

The square cross-sectional male portion 37 is preferably designed to pressure fit or snap into the female opening 41 in the second roller 39. That is, friction between the outer surface of the male portion 37 and female opening 41 maintain connection between the two rollers. Of course, other known attachment means, including fasteners or the like, may be employed to provide removable attachment between the first and second rollers. The removable attachment facilitates star cutter and roller replacement or repair.

Each of the first and second rollers, 35 and 39 respectively, has a recess 43 in a peripheral edge thereof. The recesses 43 are sized to receive an O-ring 45. The O-rings provide a resilient film material engaging surface during travel of the cutting device 1 along the guide 3. The O-rings, by their resilience, compensate for any tolerance variations that may be present in the film material 17 to be cut. Although O-rings are shown as the resilient film material engaging surface, other known resilient materials, such as a tape, may be used on the peripheral edges of the first and second rollers 35 and 39 to provide the requisite resilience and compensation described above. Alternatively, the rollers 35 and 39 can be made such that at least the peripheral portion thereof are resilient for contact with the film material 17.

The guide wheel support plates 33 also rotatably support the star cutter driver assembly 29. With particular reference to FIG. 3, each of the plates 33 is mounted to the housing 25 and extends downwardly therefrom. Each of the plates 33 has a circular opening 48; see FIG. 2, which corresponds to the cylinder defined by the step 47 of the first roller 35 and step 49 of the second roller 39; see FIG. 4. The steps 47 and 49, when the first and second rollers 35 and 39 are connected, form a cylindrical surface which permits the star cutter drive assembly to freely rotate within the circular openings 48 defined by the plates 33 during linear travel of the cutting device 1. It should be understood that FIG. 4, showing a cross-sectional view of the first and second rollers 35 and 39 in conjunction with the star cutter 27, omits the guide wheel supporting plates 33 for clarity.

Preferably, the rollers 35 and 39 are sized in diameter less than the star cutter 27 so that the star cutter 27 has a peripheral edge velocity greater than the rollers' peripheral edge velocity and linear travel of the housing to improve cutting action.

In a preferred embodiment illustrated in FIG. 3, the guide wheels 31 are formed with outer surfaces 60 and spring-like resilient adjustment portions 62 to enable the surfaces 60 to firmly engage surface 35 while allowing for variations in the thickness of the material forming surfaces 19 and 35. This is not mandatory, however, as will be shown below.

Figure 5:
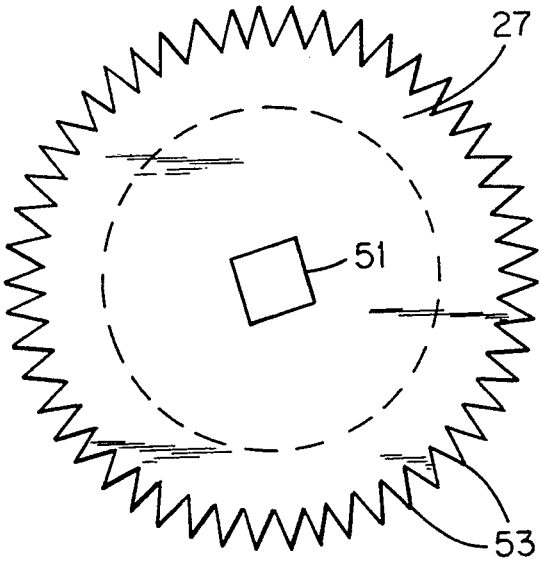
FIG. 5 is a side view of an exemplary star cutter.

With reference again to FIG. 3 and FIG. 5, the star cutter 27 is fixedly mounted between first and second rollers, 35 and 39, respectively, by virtue of the square opening 51 engaging the square male portion 37 of the first roller 35. The star wheel 27 has a plurality of teeth which function to sever the film material 17 by the perforating action of the individual teeth 53. In FIG. 5, a sixty four tooth star cutter 27 is depicted. However, star cutters having different numbers of teeth can also be utilized in the inventive cutting device, for example, an eighty tooth wheel; see FIG. 2, or a fifty tooth wheel.

Figure 6:
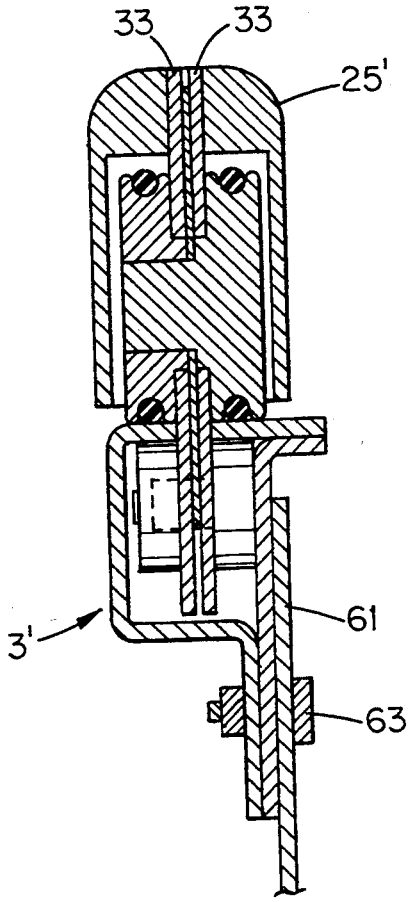
FIG. 6 is a cross-sectional view similar to FIG. 3 showing an alternative embodiment.

FIG. 6 depicts an alternative embodiment to the invention wherein the guide wheel supporting plates 33' are sandwiched by the housing 25'. This embodiment also illustrates the guide 3' without the clip 5 for attachment to the sidewall of a film material container. In this embodiment, the guide 3' can be attached to a surface 61 by a fastener 63 or the like for film material cutting. In addition, the guide wheels 31' are solid wheels and do not employ the spring-like resilient adjustment portions 62 shown in FIG. 3.

The present invention may be constructed out of any known materials including non-metallic and metallic materials. For example, the cutting device 1 and guide 3 may be made of a durable plastic to withstand repeated traversals of the guide 3 by the cutting device 1. The star cutter 27 is preferably made of a metallic material to provide a durable cutting edge during use.

The inventive film cutting apparatus provides improvements over prior art cutting apparatus when used with thin film material. Use of a star cutter or toothed wheel cuts film material such as foodservice plastics even when folded or bunched together.

Cutting is further enhanced as a result of the star cutter driver assembly which causes the peripheral edge of the star cutter to rotate at a speed greater than the linear speed of the cutting device when traversing the guide.

Use of a non-slip friction surface eliminates the need for complex mechanical arrangements above the cutting plane defined by the non-slip friction surface, thereby simplifying manufacturing and reducing manufacturing costs.

Driving the star cutter using a resilient material engaging surface also compensates for variances in the film material thickness to be cut. Thus, the stability of the cutting device during cutting is maintained in spite of any tolerance variations such as doubled up or bunched film material.

As such, an invention has been disclosed in terms of preferred embodiments thereof which fulfill each and every one of the objects of the present invention as set forth hereinabove and provide a new and improved film cutting apparatus.

Various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A film material cutting aparatus comprising a cutting device and a cutting guide, said cutting device comprising:

a) a housing;

b) a cutting wheel having a first diameter, said cutting wheel disposed in at least a portion of said housing;

c) a roller assembly for rotating said cutting wheel, said roller assembly including a pair of rollers and means for removably attaching said rollers together for fixedly mounting said cutting wheel to said roller assembly coaxially therewith such that rotation of said roller assembly drives said cutting wheel rotatively, wherein each of said rollers has a second diameter smaller that said first diameter such that a cutting wheel edge velocity is greater than a roller circumferential edge velocity during travel of said cutting device and such that said cutting wheel contacts a given portion of said film material in advance of said roller assembly during travel of said cutting device, said roller assembly having a resilient film material engaging surface defining a cutting plane coincident with said film material when being cut and being disposed in at least a portion of said housing;

d) a plurality of guide wheels for guiding said cutting device during travel thereof;

e) means for supporting said guide wheels below said cutting plane and for supporting said roller assembly above said cutting plane, said means for supporting attached to said housing and said roller assembly engaging said supporting means to permit rotation of said roller assembly and said cutting wheel;

f) said curing guide comprising an elongated member having:

i) a channel therethrough sized to receive said plurality of guide wheels;

ii) a top surface parallel to said cutting plane, said top surface having a high friction surface comprising a urethane tape applied to said top surface thereon to adhere said film material to said high friction surface during cutting; and iii) a slot in said top surface communicating with said channel, said slot sized to receive said cutting wheel during rotation thereof and said means for supporting said plurality of guide wheels.

2. The film material cutting apparatus of claim 1 further comprising a means for attaching said cutting guide to a film material container.

3. The film material cutting apparatus of claim 1 wherein said cutting wheel has a plurality of teeth to perforate said film material and wherein said resilient film material engaging surface defining said cutting plane comprises at least one O-ring.

4. The film material cutting apparatus of claim 1 wherein each said roller has a slot on a circumferential edge thereof for receiving said resilient film material engaging surface.

5. The film material cutting apparatus of claim 4 wherein each said resilient film material engaging surface is an O-ring.

6. The film material cutting apparatus of claim 1 wherein said means for supporting further comprises a pair of plates attached at one end thereof to said housing, each said plate having a circular opening therethrough for receiving said roller assembly to permit rotation of said roller assembly, said cutting wheel being disposed between said plates.

* * * * *